US009490115B2

(12) United States Patent
Smith

(10) Patent No.: US 9,490,115 B2
(45) Date of Patent: Nov. 8, 2016

(54) VARYING FREQUENCY DURING A QUADRUPOLE SCAN FOR IMPROVED RESOLUTION AND MASS RANGE

(71) Applicant: Thermo Finnigan LLC, San Jose, CA (US)

(72) Inventor: Johnathan W. Smith, San Jose, CA (US)

(73) Assignee: Thermo Finnigan LLC, San Jose, CA (US)

( * ) Notice: Subject to any disclaimer, the term of this patent is extended or adjusted under 35 U.S.C. 154(b) by 0 days.

(21) Appl. No.: 14/575,406

(22) Filed: Dec. 18, 2014

(65) Prior Publication Data

US 2016/0181084 A1 Jun. 23, 2016

(51) Int. Cl.
*H01J 49/42* (2006.01)
*H01J 49/00* (2006.01)

(52) U.S. Cl.
CPC ..... *H01J 49/4215* (2013.01); *H01J 49/0031* (2013.01); *H01J 49/426* (2013.01); *H01J 49/429* (2013.01)

(58) Field of Classification Search
CPC ..... H01J 49/0031; H01J 49/429; H01J 49/4215; H01J 49/426
See application file for complete search history.

(56) References Cited

U.S. PATENT DOCUMENTS 3,413,463 A * 11/1968 Brubaker ..... H01J 49/4215 250/290
4,535,236 A * 8/1985 Batey ..... H01J 41/10 250/282
4,816,675 A * 3/1989 Fies ..... H01J 49/4215 250/282
5,354,988 A * 10/1994 Jullien ..... H01J 49/022 250/282
5,451,782 A 9/1995 Kelley
6,753,523 B1 6/2004 Whitehouse et al.
6,838,665 B2 * 1/2005 Kato ..... H01J 49/429 250/281
7,078,686 B2 * 7/2006 Roushall ..... H01J 49/4215 250/282
7,193,207 B1 3/2007 Ding et al.
8,309,914 B2 * 11/2012 Guna ..... H01J 49/426 250/281

(Continued)

FOREIGN PATENT DOCUMENTS

CN 102683153 A 9/2012
WO WO 2006/130787 A2 12/2006
WO 20141141756 A1 9/2014

OTHER PUBLICATIONS

Shinholt, D., et al., "A frequency and amplitude scanned quadrupole mass filter for the analysis of high m/z ions" Review of Scientific Instruments 85, 113109 (Nov. 24, 2014).*

(Continued)

*Primary Examiner* — Wyatt Stoffa
(74) *Attorney, Agent, or Firm* — Thomas F. Cooney

(57) ABSTRACT

Techniques are provided for scanning frequency and voltages of a multipole mass filter while maintaining substantially the same number of AC cycles per mass during a scan across a range of masses. For example, a mass spectrum can be obtained by controlling a DC axial voltage that accelerates ions into a mass filter, a DC resolving voltage applied to the mass filter, an AC voltage amplitude applied to the mass filter, and an AC frequency of the AC voltage. The settings can be controlled such that ions of different mass-to-charge ratios are within the mass filter for substantially a same number of AC cycles. To achieve the same number of AC cycles, the AC frequency is changed during the scan. For low masses, a higher AC frequency can be used. For high masses, a lower AC frequency can be used.

7 Claims, 9 Drawing Sheets

(56) References Cited

U.S. PATENT DOCUMENTS

| | | | | |
|---|---|---|---|---|
| 8,389,929 | B2 | 3/2013 | Schoen et al. | |
| 8,410,436 | B2 * | 4/2013 | Mukaibatake | H01J 49/4215 250/288 |
| 9,190,255 | B2 * | 11/2015 | Raptakis | H01J 49/067 |
| 2004/0021072 | A1 * | 2/2004 | Soudakov | H01J 49/4225 250/292 |
| 2005/0080571 | A1 | 4/2005 | Klee | |
| 2005/0080578 | A1 | 4/2005 | Klee | |
| 2006/0038123 | A1 * | 2/2006 | Quarmby | H01J 49/427 250/292 |
| 2008/0272295 | A1 * | 11/2008 | Mircea-Guna | H01J 49/4215 250/292 |
| 2010/0038530 | A1 | 2/2010 | Giles et al. | |
| 2010/0193684 | A1 * | 8/2010 | Mukaibatake | H01J 49/022 250/292 |
| 2011/0062325 | A1 * | 3/2011 | Mukaibatake | H01J 49/4215 250/288 |
| 2011/0215235 | A1 * | 9/2011 | Schoen | H01J 49/26 250/282 |
| 2011/0315866 | A1 * | 12/2011 | Mitchell | H01J 49/429 250/282 |
| 2012/0119083 | A1 | 5/2012 | Kodera et al. | |
| 2012/0160998 | A1 * | 6/2012 | Kou | H01J 49/0031 250/286 |
| 2012/0326027 | A1 | 12/2012 | Sugiyama et al. | |
| 2013/0032709 | A1 | 2/2013 | Chen et al. | |
| 2013/0200261 | A1 * | 8/2013 | Mizutani | H01J 49/02 250/290 |
| 2013/0228682 | A1 * | 9/2013 | Yasuda | H01J 49/0045 250/282 |
| 2013/0234018 | A1 * | 9/2013 | Mizutani | H01J 49/4215 250/294 |
| 2013/0292563 | A1 * | 11/2013 | Green | H01J 49/004 250/282 |
| 2013/0313427 | A1 * | 11/2013 | Mizutani | H01J 49/022 250/290 |
| 2014/0001354 | A1 | 1/2014 | Asano | |
| 2014/0151544 | A1 * | 6/2014 | Grothe, Jr. | H01J 49/4215 250/282 |
| 2014/0264008 | A1 * | 9/2014 | Hoyes | H01J 49/4235 250/282 |
| 2015/0034820 | A1 | 2/2015 | Evans-Nguyen et al. | |
| 2015/0228469 | A1 * | 8/2015 | Mizutani | H01J 49/4215 250/292 |
| 2015/0364303 | A1 * | 12/2015 | Remes | H01J 49/0031 250/282 |
| 2015/0380232 | A1 * | 12/2015 | Brown | H01J 49/428 250/282 |

OTHER PUBLICATIONS

Sablier, M., et al., "Varying the radio frequency: A new scanning mode for quardupole analyzers", Rapid Communications in Mass Spectrometry (1998).*

Leck, "Partial pressure measurement; Proceedings of CERN Accelerator School Vacuum Technology", (1999), pp. 89-97,URL: http://www.chem.elte.hu/departments/altkem/vakuumtechnika/CERN08.pdf.

J. W. Smith, et al., "Method for Determining a Spectrum from Time-Varying Data", U.S. Appl. No. 14/263,947, filed Apr. 28, 2014.

Syed et al.,"Quadrupole Mass Filter: Design and Performance for Operation in Stability Zone 3", Journal of The American Society for Mass Spectrometry, 2013, vol. 24 (10), pp. 1493-1500.

Voo et al.: "Transmission through the quadrupole mass spectrometer mass filter: The effect of aperture and harmonics", Journal of Vacuum Science and Technology: Part A, 1997, vol. 15 (4), pp. 2276-2281.

* cited by examiner

VARYING FREQUENCY DURING A QUADRUPOLE SCAN FOR IMPROVED RESOLUTION AND MASS RANGE

CROSS-REFERENCES TO RELATED APPLICATIONS

This application is related to commonly owned U.S. Pat. No. 8,389,929 entitled "Quadrupole Mass Spectrometer With Enhanced Sensitivity And Mass Resolving Power" by Schoen et al., filed Mar. 2, 2010; and U.S. patent application Ser. No. 14/263,947 entitled "Method for Determining a Spectrum from Time-Varying Data" by Smith et. al., filed Apr. 28, 2014, the disclosures of which are incorporated by reference in their entirety.

FIELD

The present disclosure generally relates to mass spectrometry, and more specifically to techniques for scanning settings for a quadrupole mass filter to obtain a mass spectrum.

BACKGROUND

A quadrupole can be used as a mass filter such that ions of only a certain range of mass-to-charge ratios (also referred to as mass) are transmitted through the quadrupole. Such ions are considered to have a stable trajectory. Ions having a mass-to-charge ratio that is outside the stability range are filtered out. The stability range can be varied over time in a scan, thereby providing a mass spectrum over the scanned mass range.

Stability limits are set via applied AC and DC potentials that are capable of being ramped as a function of time such that ions with a specific range of mass-to-charge ratios have stable trajectories throughout the device. In particular, by applying fixed and/or ramped AC and DC voltages to configured cylindrical or hyperbolic electrode rod pairs, desired electrical fields stabilize the motion of predetermined ions in the x and y dimensions. As a result, the applied electrical field in the x-axis stabilizes the trajectory of heavier ions, whereas the lighter ions have unstable trajectories. By contrast, the electrical field in the y-axis stabilizes the trajectories of lighter ions, whereas the heavier ions have unstable trajectories. The range of masses that have stable trajectories in the quadrupole and thus arrive at a detector placed at the exit cross section of the quadrupole rod set is defined by the mass stability limits. In a typical operation, by varying the mass stability limits monotonically in time, the mass-to-charge ratio of an ion can be (approximately) determined from its arrival time at the detector.

In a conventional quadrupole mass spectrometer, the uncertainty in estimating of the mass-to-charge ratio from its arrival time corresponds to the width between the mass stability limits. This uncertainty can be reduced by narrowing the mass stability limits, i.e. operating the quadrupole as a narrow-band filter. In this mode, the mass resolving power of the quadrupole is enhanced as ions outside the narrow band of "stable" masses crash into the rods rather than passing through to the detector. However, the improved mass resolving power comes at the expense of sensitivity. In particular, when the stability limits are narrow, even "stable" masses are only marginally stable, and thus, only a relatively small fraction of these reach the detector.

In U.S. Pat. No. 8,389,929, a broader stability range is used to increase sensitivity. And, a deconvolution algorithm is used to quantify signals from various masses that may be stable at the same time. For example, temporal and spatial information at the detector can be used in the deconvolution process. Herein, such techniques are called broad-stability techniques or deconvolution techniques. However, the effectiveness of such techniques to increase sensitivity without sacrificing resolution can be reliant on maintaining careful control of the number of oscillatory field cycles experienced by the transmitted ions. Methods for controlling this parameter can be difficult to implement in practical instruments.

Therefore, it is desirable to provide new scanning techniques that address such problems when broad-stability techniques are used.

BRIEF SUMMARY

Embodiments of the present invention provide systems, methods, and apparatuses for scanning frequency and voltages of a multipole mass filter while maintaining substantially the same number of AC cycles per mass during a scan across a range of masses. For example, a mass spectrum can be obtained by controlling a DC axial voltage that accelerates ions into a mass filter, a DC resolving voltage applied to the mass filter, an AC voltage amplitude applied to the mass filter, and an AC frequency of the AC voltage. The settings can be controlled such that ions of different mass-to-charge ratios are within the mass filter for substantially a same number of AC cycles. To achieve the same number of AC cycles, the AC frequency is changed during the scan. For low masses, a higher AC frequency can be used. For high masses, a lower AC frequency can be used. This change in AC frequency can allow the objective of maintaining the number of AC cycles constant to be achieved without requiring an excessively wide variation in other parameters (e.g., DC axial voltage) that may result in operational problems.

Other embodiments are directed to systems and computer readable media associated with methods described herein.

A better understanding of the nature and advantages of embodiments of the present invention may be gained with reference to the following detailed description and the accompanying drawings.

DEFINITIONS

A "spectrum" of a sample corresponds to a set of data points, where each data point includes at least two values. A first value corresponds to a discriminating parameter of the spectrum, such as a mass or frequency. The parameter is discriminating in that the particles are differentiated in the spectrum based on values for the parameter. The second value corresponds to an amount of particles measured from the sample that have the first value for the parameter. For instance, a data point can provide an amount of ions having a particular mass-to-charge ratio (also sometimes referred to as "mass").

An "axial DC voltage" refers to a voltage used to accelerate an ion in a mass spectrometer along the major axis of travel of the ion path within the mass spectrometer. The axial DC voltage may apply a certain amount of energy to ions (e.g. 50 eV) before the ions are transmitted to the quadrupole mass filter. The actual DC voltage may be changed to increase the amount of energy imparted to the ions, e.g., to maintain a constant speed across different masses.

A quadrupole mass filter (also referred to as an analyzer) includes four rods that are set parallel to each other. A DC resolving and an AC voltage are applied to the rods. The DC resolving voltage refers to a voltage signal of constant magnitude U (also referred to as DC amplitude) applied to the quadrupole (where two poles have a negative voltage and two poles have a positive voltage). The AC voltage refers to a voltage signal of oscillating magnitude, e.g., defined as V cos(wt), where V is the AC amplitude and w is the oscillating frequency of the AC voltage. The AC voltages typically have frequencies in the RF range, and thus are often referred to as RF voltages.

DETAILED DESCRIPTION

When using broad-stability techniques, it can be beneficial to have ions encounter a same number of AC cycles when traveling through a multipole mass filter, where the AC cycles are of AC voltage applied to the multipoles. However, maintaining the same number of AC cycles can be difficult or cause problems at high and low masses. Embodiments provide new operation modes for a multipole mass spectrometer. Scanning settings can be set in a number of different ways while maintaining substantially equal RF cycles per mass. For example, instead of simply adjusting the axial voltage and the quadrupole filter voltages (DC and AC), a new mode includes the adjustment of the RF frequency, e.g., in combination with scanning the quadrupole filter voltages. Various other modes can be used when the RF frequency changes. This allows for improved mass-invariant RF cycle counts and a greater mass range when broad-stability techniques are used.

I. SCANNING VOLTAGES OF A QUADRUPOLE

Figure 1:
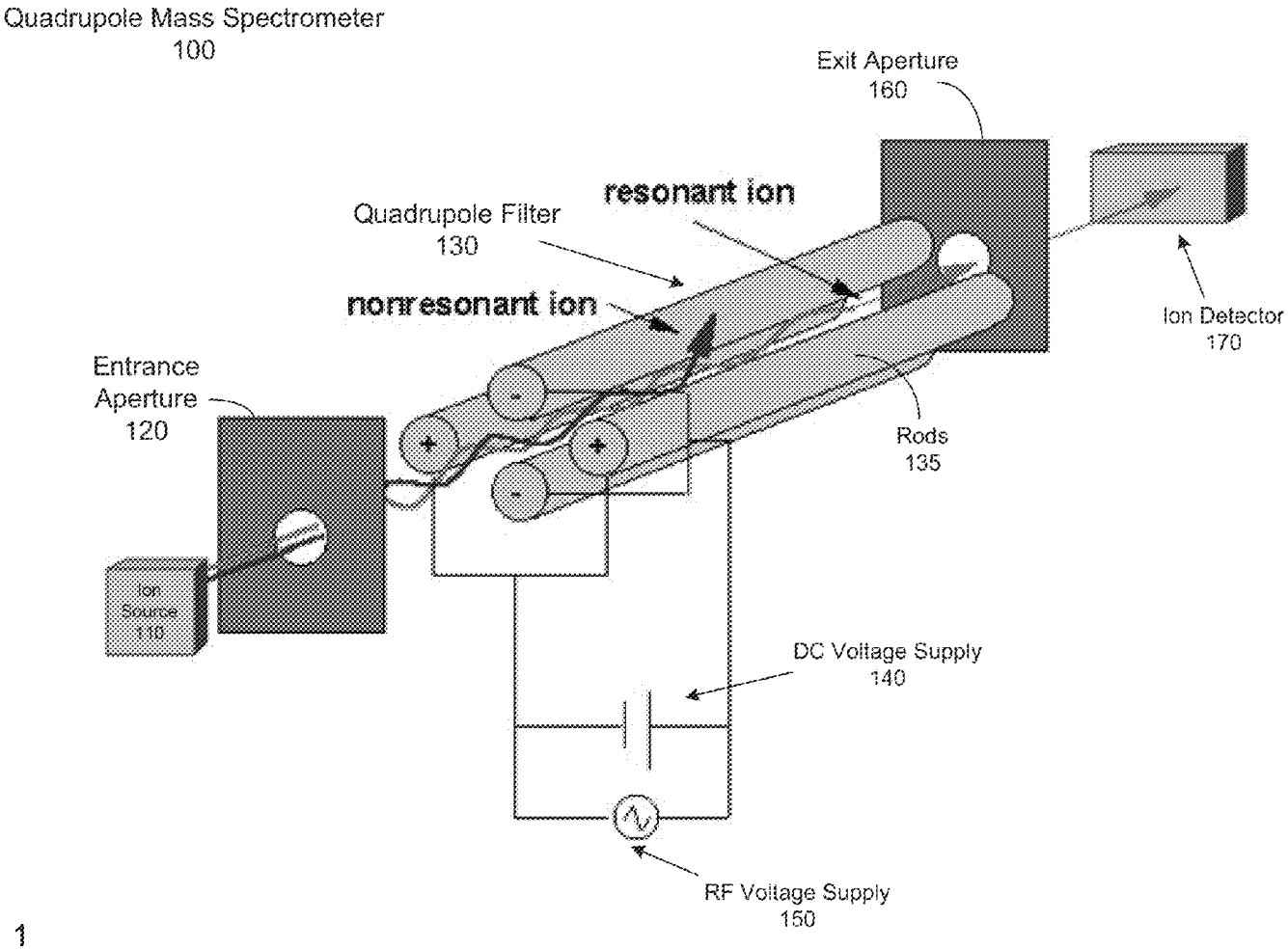
FIG. 1 shows an example quadrupole mass spectrometer 100 according to embodiments of the present invention.

FIG. 1 shows an example quadrupole mass spectrometer 100 according to embodiments of the present invention. As shown, quadrupole mass spectrometer 100 comprises ion source 110, entrance aperture 120, quadrupole filter 130 with DC voltage supply 140 and RF voltage supply 150, exit aperture 160, and ion detector 170. Quadrupole mass spectrometer 100 can also include ion optics to accelerate and focus the ions through entrance aperture 120, detection electronics, and a high-vacuum system. An example length of quadrupole filter 130 is ¼ m long, and an example amount of energy for an ion exiting the ion optics is 10 eV per 100 amu.

Quadrupole filter 130 includes four parallel metal rods 135. Two opposite rods have an applied potential of (U+V cos(wt)) and the other two rods have a potential of −(U+V cos(wt)), where U is the DC resolving voltage and V cos(wt) is the RF voltage (also referred to as an AC voltage). The oscillating frequency w corresponds to how fast the AC voltage is changing.

The applied DC and AC voltage amplitudes and the AC oscillating frequency w affect the trajectory of ions, e.g., whether the ions travel down the flight path centered between the four rods 135. For given DC and RF voltages, only ions of a certain range of mass-to-charge ratios (also referred to as simply "mass") pass through quadrupole filter 130 and exit aperture 160 to be detected by ion detector 170. Such ions are depicted as a resonant ion. Other ions are forced out of the central path and are not detected by ion detector 170. Thus, if the values of the DC and AC voltages are changed, different masses will pass through quadrupole filter 130, and will be detected by ion detector 170.

Two scanning process have been employed to produce a mass spectrum. In one scanning process, U and V are changed (scanned) over time to provide a mass spectrum while keeping the oscillating frequency w constant. In the second scanning process, the oscillating frequency w is changed while keeping U and V constant, which generally has not provided good results. Both techniques can have problems, particularly at high or low masses when using a broad-stability technique.

The resulting mass spectrum provides a measurement of a number of ions in a particular mass-to-charge ratio at any given instant in time. Conventional quadrupole mass filters are typically operated at about unit resolution such that at any given time, only ions having a mass-to-charge ratio within a range of 1 m/z (also referred to as 1 Thomson (Th)) are detected and measured. However, to obtain greater sensitivity, embodiments can transmit a broader range of masses. Such techniques are described in more detail below with regards to the Mathieu equations in the next section.

II. TEMPORAL RESOLUTION

In spectrometry, a device is commonly set to detect only particles having a single value for the discriminating parameter (e.g., mass or frequency) at any given time. For example, a mass spectrometer can be set to detect ions at a particular mass-to-charge ratio at a given instant in time. The settings of the mass spectrometer can then be changed to detect a different mass-to-charge ratio (sometimes referred to as just "mass"). To obtain high accuracy and detecting a particular mass, e.g., fractions of atomic mass unit (amu), then the mass spectrometer would have to be set to only detect a very narrow range of masses. However, using a very narrow range reduces sensitivity. Thus, embodiments can be set to detect particles having a relatively wide range for the discriminating parameter, thereby improving sensitivity. But, to maintain the resolution, a deconvolution process can be used to identify the signals corresponding to the different particles.

For example, embodiments of a high performance quadrupole system can use a deconvolution approach to extract mass spectral data from a sequence of multidimensional images produced by an ion detection system. An imaging system can detect ion trajectory details at the exit of a quadrupole mass filter and use that information to extract mass spectra at higher sensitivity and resolution than possible with a classically operated quadrupole mass spectrometer. The quadrupole is a mass dispersive technology and not just a mass filter. A software challenge is to extract mass spectra from this data in real time, which can be difficult since particles with different parameters are simultaneously being detected at a given instant in time. The particles may be detected on a two-dimensional plane (or other number of dimensions), which may be used in the analysis to discriminate among particles with different parameters. In some embodiments, particles may just be detected at various points in time, with no spatial resolution.

A. Spectrometry Data

As mentioned above, particles with a relatively broad range for the discriminating parameter are detected at any instant in time. The manner of controlling the range of particles can vary depending on the type of spectrometry data. For a quadrupole mass spectrometer, the range is governed by the Mathieu equation. For a particle to be detected, the trajectory along the quadrupoles needs to be stable in the X and Y directions that are transverse to the motion along the quadrupoles.

Figure 2:
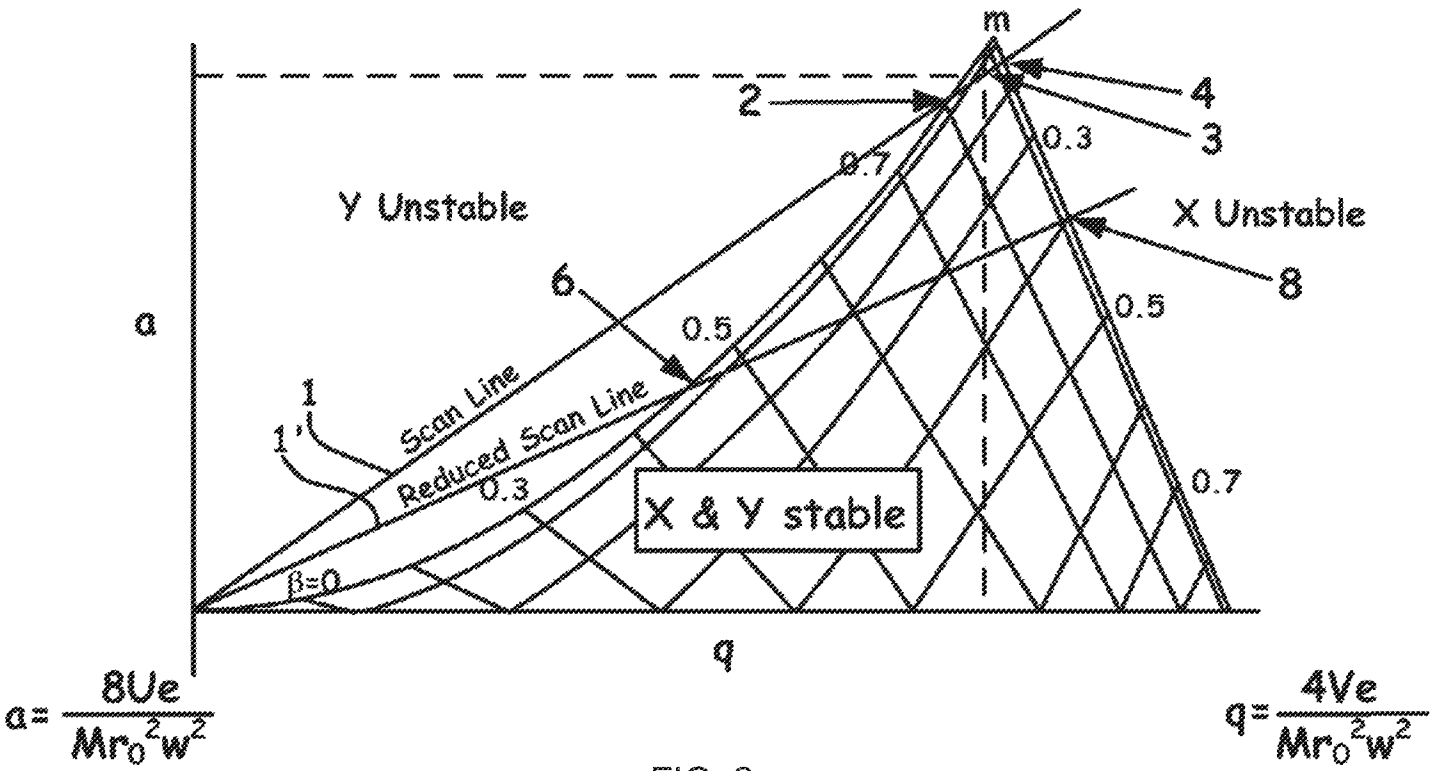
FIG. 2 shows the Mathieu stability diagram with a scan line representing narrower mass stability limits and a "reduced resolution" scan line, in which the DC/RF ratio has been reduced to provide wider mass stability limits.

FIG. 2 shows such an example of a Mathieu quadrupole stability diagram for ions of a particular mass/charge ratio. The Mathieu equation can be expressed in terms of two unitless parameters, a and q, where a is proportional to a DC magnitude and q is proportional to an AC amplitude (also referred to as RF amplitude). The parameters a and q are unitless parameters that normalize the ion mass to charge ratio and system design parameters such as RF frequency and quadrupole field radius, as is well known in the art. Therefore, the Mathieu stability diagram is a mass independent representation of the a:q parameter space designating settings that yield stable ion trajectories. FIG. 2 shows a stable region in the middle where the trajectory is stable, an unstable region on the left where the trajectory is not stable in the Y direction, and an unstable region on the right where the trajectory is not stable in the X direction, where the X and Y directions are defined relative to the quadrupole rods. Only particles in the stable region will pass through the quadruple and be detected.

The operating scan line 1 is a set of values that are inversely proportional to mass. Different points on scan line 1 correspond to different masses. The masses that fall within the crosshatched stable region have a stable trajectory. As shown, masses on scan line 1 between entrance 2 and exit 4 are stable. The mass m corresponds to the mass at the peak 3 of the stable region. Having scan line 1 intersect at the top of the stable region causes a relatively narrow range of masses to have a stable trajectory, and thus be detected.

To detect different masses, a and q are changed in a predetermined manner. As these values change, different masses will have a stable trajectory. Conceptually, the peak of the stable region can travel along scan line 1, thereby causing a different mass (or relatively narrow range of masses) to be detected at different times, in conjunction with the progressive change in a and q. However, having a narrow range of detectable masses can decrease sensitivity.

A reduced scan line 1 provides a larger range of masses to be detected, as shown by penchant 6 and exit 8. This increase in sensitivity can come at the cost of a lower resolution, if the raw data was simply taken as is. To solve this problem, embodiments identify that different masses will enter the stable region at different times and exit the stable region at different times. Each mass exhibits a different pattern on the two-dimensional detector. As described in U.S. Pat. No. 8,389,929, a deconvolution can be used to identify contributions in the spectrometry data from particles with different masses. As described below, embodiments of U.S. patent application Ser. No. 14/263,947 provide improved analysis in determining a spectrum using values obtained for the deconvolution. The deconvolution can involve solving for a spectrum x in Ax=b, where A is the autocorrelation matrix of reference basis functions (e.g., each corresponding to a particular mass) and b is a cross-correlation vector that corresponds to measured data.

In other embodiments, the detector can acquire position in only one dimension, as opposed to two dimensions. Further, an exit phase of the particle can be detected to identify its position in three dimensions, e.g., by using the exit phase in combination with two-dimensional spatial resolution data. The range of the discriminating parameter for other spectrometry data can be determined in a different manner than described above for a quadrupole mass spectrometer. As other examples, the exit phase can be combined with spatial resolution data in one dimension to provide a position in two-dimensions, or the phase information alone can constitute a single dimension of data.

In one embodiment, just the exit time without phase information or spatial resolution can be used, e.g., just the detection time can be used with no spatial resolution. For example, the amount of particles being detected at any point of time would be a combination of the ions whose mass falls within the stable region. The various contributions from the different masses to the amount for each time period can be extracted, as is described below.

B. System

Figure 3:
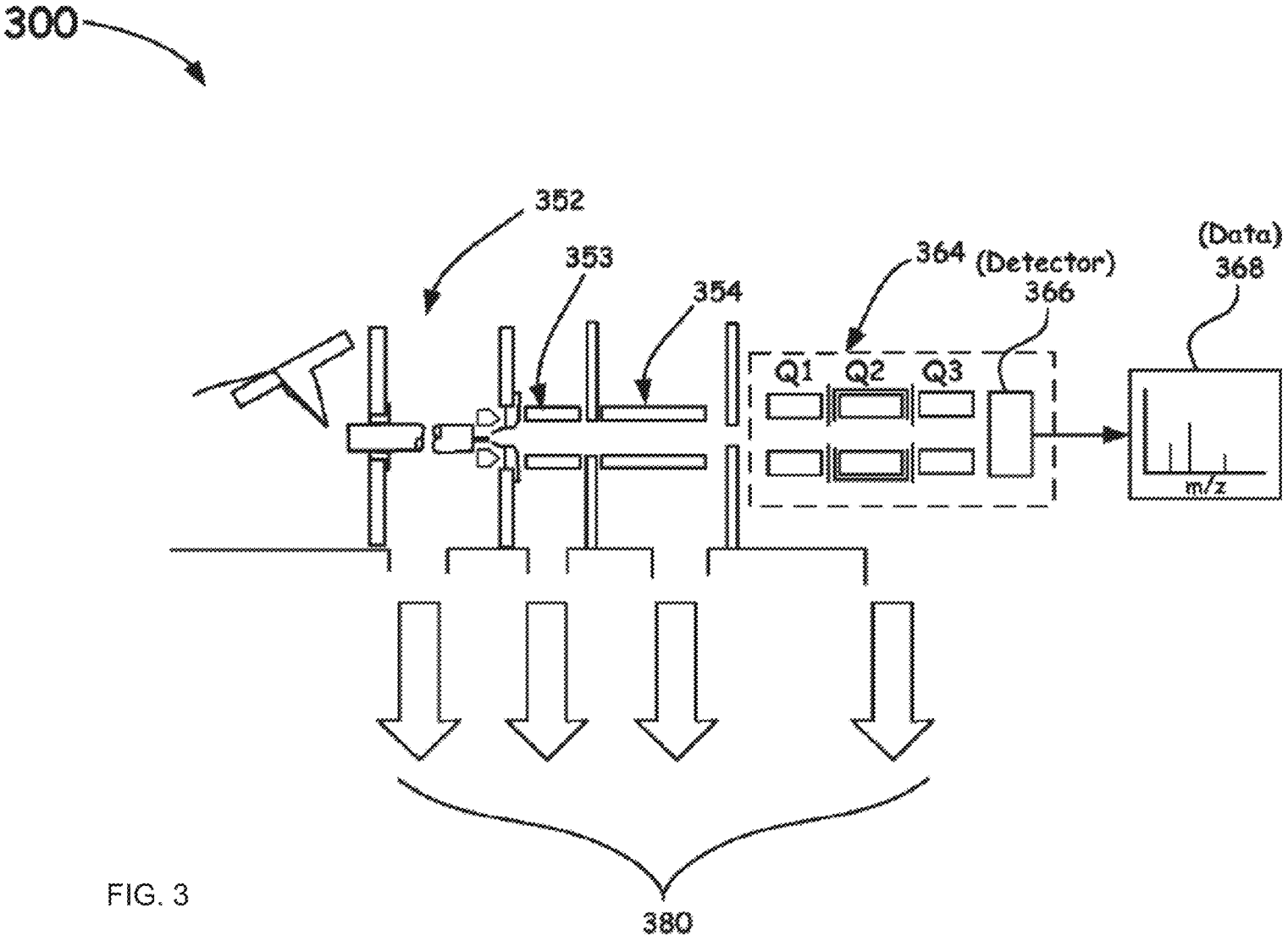
FIG. 3 shows a beneficial example configuration of a triple stage mass spectrometer system that can be operated with the methods of the present invention.

FIG. 3 shows an example configuration of a triple stage mass spectrometer system (e.g., a commercial TSQ). The operation of mass spectrometer 300 can be controlled and data can be acquired by a control and data system (not depicted) of various circuitry of a known type, which may be implemented as any one or a combination of general or special-purpose processors (digital signal processor (DSP)), firmware, software to provide instrument control and data analysis for mass spectrometers and/or related instruments, and hardware circuitry configured to execute a set of instructions that embody the prescribed data analysis and control routines of the present invention. Such processing of the data may also include averaging, scan grouping, deconvolution as disclosed herein, library searches, data storage, and data reporting.

A sample containing one or more analytes of interest can be ionized via an ion source 352. The resultant ions are directed via predetermined ion optics that often can include tube lenses, skimmers, and multipoles, e.g., reference characters 353 and 354, selected from radio-frequency RF quadrupole and octopole ion guides, etc., so as to be urged through a series of chambers of progressively reduced pressure that operationally guide and focus such ions to provide good transmission efficiencies. The various chambers communicate with corresponding ports 380 (represented as arrows in the figure) that are coupled to a set of pumps (not shown) to maintain the pressures at the desired values.

The example spectrometer 300 includes a triple quadrupole configuration 364 having sections labeled Q1, Q2 and Q3 electrically coupled to respective power supplies (not shown) so as to perform as quadrupole ion guides. The ions having a stable trajectory reach a detector 366, which can detect particles hitting the detector at any given instant in time. In some embodiments, detector 366 can also detect a position of an ion in one or more spatial dimensions (e.g., a position in a 2D grid). The 2D spatial dimension can be partitioned into different grid elements of an X-Y grid, where a grid element would be a smallest unit of resolution in the 2D grid. The spectrometry data can include an intensity at each location for each time step.

Such a detector is beneficially placed at the channel exit of quadrupole Q3 to provide data that can be deconvolved into a rich mass spectrum 368. The resulting time-dependent data resulting from such an operation is converted into a mass spectrum by applying deconvolution methods described herein that convert the collection of recorded ion arrival times and positions into a set of m/z values and relative abundances.

To detect a location, a lens assembly can be used, e.g., to detect spatial information and allow the use of the camera. Spectrometer 300 can include a helium cooling cell to produce a mono energetic ion beam to ensure each ion species produces a same set of images. Instrument parameters set to be invariant with ion mass can help provide uniformity for a set of images for any given individual mass-to-charge species across the mass range. The exit position and time of every ion can be recorded at a rate of several million frames per second.

In some implementations, a unit resolution of acquisition is a multidimensional representation of ion exit patterns. The unit can be referred to as a voxel or a volumetric pixel. Each voxel can correspond to a stack of image planes taken at a number of times (e.g., 8 or even just 1) spanning one quadrupole RF cycle. A voxel can include values from non-consecutive image planes, e.g., from different scans.

Each image plane corresponds to a different measurement at a different instant of time of intensities of ions hitting respective grid elements of the X-Y grid. Each voxel can correspond to a different grid element. The values of the planes for a voxel can be summed or a voxel can have an array of values. The number of planes in a voxel depends on how fast the images are being taken and the time of a cycle (i.e., how fast the RF device cycle time is). In one embodiment, the device would be scanned at the same rate for all samples. Fewer planes can reduce the data load per voxel to allow more voxels per second and therefore scan faster.

As an example, each plane can be a 64 by 64 pixel image, binned into 64 rows and 64 columns aligned with the quadrupole's x and y axes for a total of 128 readings per plane, as a compression of the 4096 pixels of the image plane. The binning can gum the values in a row and sum the values in a column, where some normalization could also be done. In this example, each pixel has a multichannel analyzer for the 8 sub-RF image planes that allows multiple RF cycles to be accumulated in a voxel.

A voxel plane can include the compressed 128 readings within a compressed image plane. A voxel plane can include any number of compressed image planes, including non-consecutive compressed image planes, e.g., from different scans. The image planes of a voxel or a voxel plane can include data taken with different machine parameters (e.g., different DC offsets and settings corresponding to different scan lines), where the image planes of a voxel or voxel plane may be taken sequentially or non-sequentially in time.

In the example using 8 planes for a voxel plane, each voxel plane would include 8 compressed image planes by 128 reading per compressed image plane or 1024 readings per voxel plane. The data throughput is therefore 143.744 megabytes per second when reading values are 16 bits. This amount of data can easily be handled by a 4 or 8 lane PCI express bus. Using 16 RF cycles for the binning and sampling process, 1.123 MHz RF results in exactly 70187.5 multidimensional voxel planes per second. A total value can be determined for a voxel plane or the voxels themselves, where all correspond to different ways to determine a total value for a total intensity for an array of voxels.

III. STABILITY RANGE AND RF CYCLES

As mentioned above, when a broad-stability mode is used with a quadrupole, the a and q parameters in the Mathieu equation are scanned invariant with mass in order to obtain useful spectra. For example, ions of each mass have a same pattern at the detector except shifted in time, thereby allowing a deconvolution. The Mathieu equations are:

$$a = \frac{8\,eU}{w^2 r_0^2 m}$$

$$q = \frac{4\,\mathrm{eV}}{w^2 r_0^2 m}.$$

U represents the magnitude of the DC voltage (also referred to as the "resolving" DC voltage), V represents the magnitude (or amplitude) of the RF voltage, w represents the frequency of the RF voltage, $r_0$ represents the radius of the quadrupole (i.e., the distance from the center path of the quadrupole to a rod), and m represents the mass-to-charge ratio (also referred to as "mass") of an ion. Accordingly, for a given mass, and for certain U, V, w, and $r_0$ settings, the parameters a and q can be determined. It follows that different masses will result in different a and q values. As discussed with reference to FIG. 2, an ion will pass through a quadrupole and be detected if the a and q values are within the stability region.

In order to resolve different mass-to-charge ratios (e.g., each mass having a same pattern at the detector except shifted in time), the ions should experience a similar number of RF cycles in the quadrupole filter. Variations in the number of RF cycles can result in different patterns, thereby causing problems in deconvolution. For example, too much variation in RF cycles, and the images end up looking blurry and smeared, causing a loss in information content. The number of RF cycles experienced by each ion passing through the quadrupole is a function the RF frequency and the ion velocity.

As discussed above, the deconvolution can differentiate masses when the ions encounter substantially similar conditions, thereby resulting in similar patterns across masses. The patterns are affected by the number of RF cycles. The position of the ion on the detector depends on the RF phase initially encountered when the ion enters the quadrupole. The position will also be affected by a number of RF cycles encountered. Thus, if an ion encounters one extra RF cycle or one fewer RF cycle, the position would change, thereby leading to different patterns for different masses.

In some embodiments, a 1-2% error may be the maximum tolerable error for obtaining useful data. However, at higher numbers of RF cycles, there may be a greater tolerance for variance. For example, having one more or less RF cycle may be tolerable at higher numbers of RF cycles, while it may render the data useless at lower numbers of RF cycles. In some embodiments, ions with different mass-to-charge ratios may experience some variation in number of RF cycles, such as less than 1%, 2%, 3%, 4%, or 5%. In other embodiments, the RF cycle count may be n±1 cycles, n±2 cycles, n±3 cycles, or n±4 cycles.

Accordingly, when a broad-stability mode is used, the mass-to-charge ratio of ions can be determined by the pattern of ion collision locations at the detector, provided the ions are experiencing a similar number of RF cycles in the quadrupole filter. Spectrometer parameters (e.g., U,V, w, and the axial voltage) can be varied such that different masses can pass through quadrupole filter, all the while maintaining substantially the same number RF cycles.

As for choosing the number of RF cycles for the scan, at high numbers of cycles, a small fractional change in ion speed/energy can result in a large change in cycle count (e.g., a large absolute change). Accordingly, a high number of cycles (e.g. 200) can result in a blurry output. On the other hand, at a low RF cycle count, the same fractional change in ion energy/speed does not cause the same amount of variation in cycle count. For example, when setting for 20 cycles, a velocity change of about 5% can cause an extra cycle count. A typical number of RF cycles may be in the range of 50 to 100. The lower end of practical cycle numbers may be about 17, and the higher end may be slightly over 100.

IV. PROBLEMS KEEPING SAME RF CYCLES ACROSS MASSES

Classically, when obtaining a mass spectrum, the frequency w has been fixed and the parameters a and q have been adjusted by changing the RF amplitude V and DC amplitude U on the rods. However, such operation would cause a change in the number of RF cycles encountered ions of different masses. As mentioned above, to obtain meaningful data that can be resolved (e.g., data that is not too blurry) using deconvolution, the number of RF cycles per mass should be maintained relatively constant. One can vary axial voltage (e.g., as produced by ion optics) during scanning, but a number of problems are encountered at high and low axial voltages for high and low mass-to-charge ratios.

To achieve a relatively constant number of RF cycles, the DC axial voltage on the quadrupole could increase with mass, along with increasing U and V during a scan. For example, as mass increases, the axial voltage can increase, such that higher masses are accelerated to the same speed that the lower masses previously attained. In such case, since different masses would have substantially the same speed, and because the RF frequency is fixed, each mass would encounter substantially the same number of RF cycles while traveling through the quadrupole filter.

While this technique achieves the goal of having a constant number of RF cycles per mass during a scan, a number of other problems are created. For example, very high axial voltages are needed when scanning for high masses. For different masses to have the same speed through the quadrupole, the axial voltage would need to be continually increased as mass increases, such that the same speed is achieved for each mass. However, this can require a very high axial voltage and ion energies at high masses. Such high voltages may be difficult to achieve (e.g., 10V per 100 amu). Additionally, U and V can become large for high masses.

At the exit of a quadrupole filter, additional optics can transfer the image from the variable offset quadrupole to a static voltage dynode/MCP device, which initiates the imaging of the ion beam. The additional optics can be electrodynamic optics that focus/alter ion and electron movement. An MCP is a "micro channel plate," which is a device that includes a small glass plate with typically thousands of micron sized channel electron multipliers. The multipliers can be laid out across the surface of the device going through the plate such that if an ion hits one of the multipliers on the front side, then a cloud of electrons, typically 1000 to 20000 electrons, will exit that channel multiplier on the other side. The electrons can be converted into photons (e.g., by accelerating the electrons into a phosphor), which can then be detected by a high speed camera. Further details are provided in owned U.S. Pat. No. 8,389,929.

At both ends of the quadrupole, it is ideal to keep all effects from fringe fields and ion optic focusing invariant with mass. Pulling ions out of the cooling cell with ever more energy to focus into a higher energy quadrupole is unlikely to result in optimal ion cooling, e.g., cooling in the radial and axial direction. Thus, applying higher energies to larger masses can cause complications.

Additional problems can be encountered when trying to fix the RF cycle count for low masses. In some embodiments, the mass spectrometer can include ion optics to transition from a cooling cell to the quadrupole. In order to control the speed and energy of the ions, the ions are cooled to a desired energy prior to acceleration to a desired speed, as part of achieving a uniform number of cycles encountered by the ions.

The ions exiting the cooling cell will have a certain axial energy distribution. This energy distribution can be kept relatively narrow, thereby having the final speeds in the quadrupole be within a narrow range. Having the final speeds in a narrow range results in the ions encountering substantially the same number of RF cycles.

But, for low masses, the desired final speed can be relatively small. Thus, the energy upon exiting the collision cell needs to be relatively small. At low energies, the relative error in the axial energy distribution is a high percentage of the energy. For example, when the energy drops below about 50 volts, the axial energy distribution can have an error of about 1 V. This high percentage error in energies upon exiting the cooling cell will translate into a high percentage error in the number of RF cycles encountered. Thus, there can be reduced energy resolution at low masses.

V. CHANGING FREQUENCY AND VOLTAGE

In order to address some of these concerns, and to extend the mass range without limitations from breakdown voltages on the quadrupole, the spectrometer can be operated such that the frequency of the RF voltage on the quadrupole is varied with mass. As explained above, the problems associated with keeping the same number of RF cycles result from needing low energies for small masses, or needing high axial voltages for large masses. Varying the RF frequency can remove the need for low energies for low masses and high axial voltages for high masses. For example, by changing frequency, a constant speed is not required to maintain a same number of RF cycles.

For low masses, the problem was that, in order to keep a constant RF cycle count, the ions needed to have low energy so that they traveled the required speed. When the axial energy is too low, resolution is lost due to cooling limits (too much relative speed spread among ions). In some embodiments, the frequency can be relatively high so that high speeds (energies) can be used. The higher frequency means that desired number of RF cycles can be encountered at the high speeds. With the ability to use high energies, the relative error in the energies of the ions exiting the cooling cell can be kept relatively small and approximately constant.

For high masses, the problem was that, in order to keep a constant RF cycle count, the ions needed to have high energy in order to travel the required speed. The required speed was achieved by high axial voltage and therefore high axial energy. But, when the axial energy is too high, resolution can be lost due to fringe field effects, and there is a limit to how high the axial voltage can be. In embodiments, this is overcome by keeping the axial voltage lower and decreasing the frequency. The lower axial voltage keeps the energy in a normal operating region, but it results in lower speed. The lower frequency counters the lower speed such that the same number of RF cycles is experienced by each ion. This also removes the high mass limit, and allows for even larger masses to be scanned.

Thus, various problems associated with keeping the RF cycles constant with mass are overcome by changing the frequency. Higher frequencies can be used at low masses, and lower frequencies at high masses. This allows the axial voltage and axial energies to stay in a moderate range while scanning for high and low masses, all the while keeping the RF cycles invariant with mass and remaining in a stable region during scanning.

A goal is to obtain a spectrum of different mass-to-charge ions with a quadrupole mass spectrometer. The spectrum can obtained by adjusting the instrument settings to look for different masses, while making sure that the settings are always such that the scan is within a stable region, and such that the number of RF cycles is mass-independent. Example instrument settings that can be adjusted include U (DC voltage magnitude), V (AC voltage magnitude), w (RF voltage frequency), and DC axial voltage.

The frequency, U, V, and axial voltage can be adjusted in a number of different manners while still maintaining the RF cycle count and stable region. For example, the axial energies may still span a certain range during the scan, or the axial voltage may be held constant. These options will be discussed in detail below.

A. System

Figure 4:
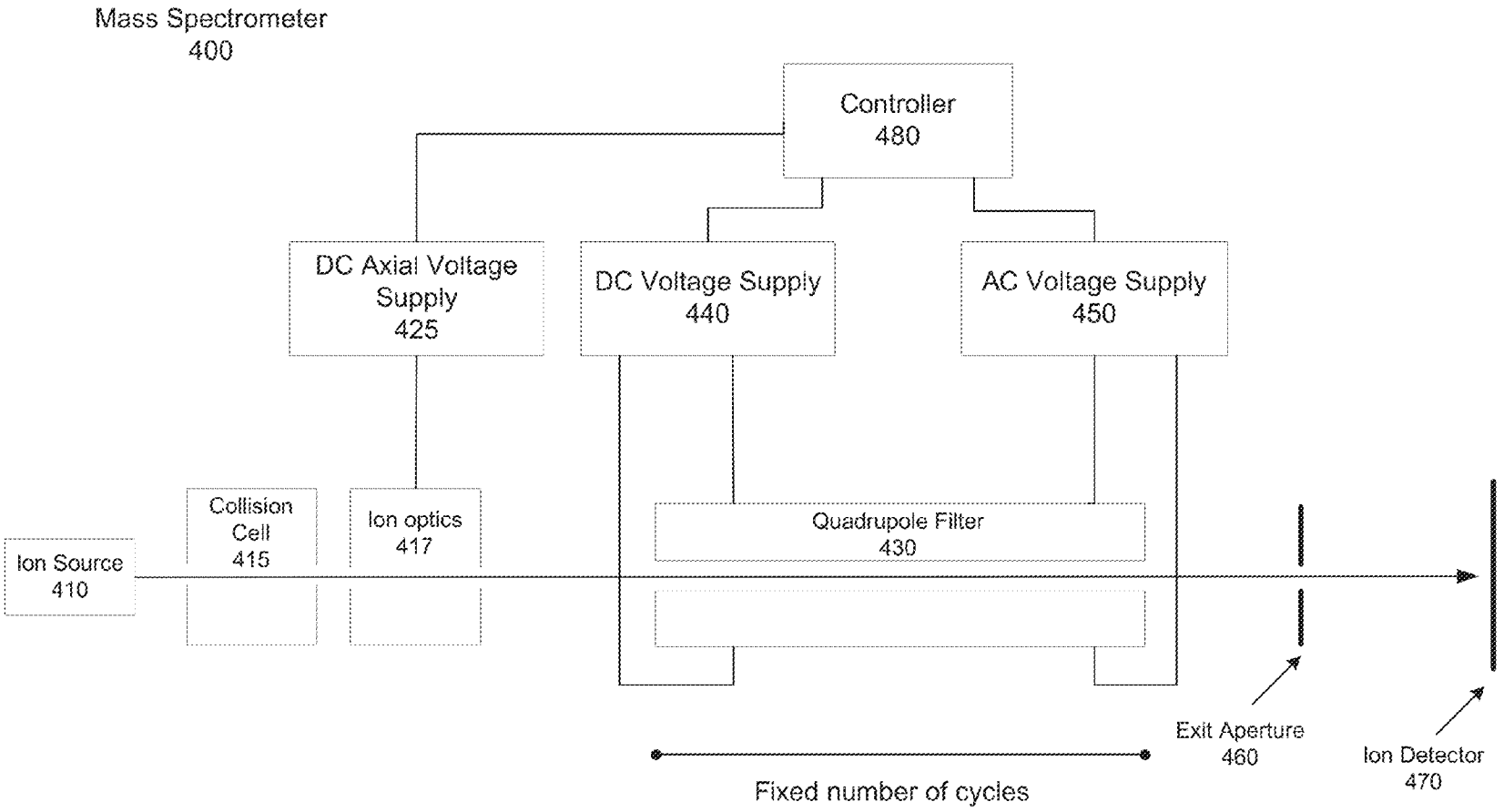
FIG. 4 shows an example quadrupole mass spectrometer that can be used to maintain a mass-invariant RF cycle count according to embodiments of the present invention.

FIG. 4 shows an example mass spectrometer 400 that can be used to maintain a mass-invariant RF cycle count according to embodiments of the present invention. Mass spectrometer 400 can be a quadrupole mass spectrometer. For example, a frequency of an AC voltage on the quadrupole can be varied to maintain RF cycle invariance during scanning.

Quadrupole mass spectrometer 400 comprises ion source 410 for producing ions. Ion source 410 can be any suitable ion source, as will be known to one skilled in the art. Ions can be transmitted from ion source 410 to a collision cell 415.

Collision cell 415 can provide ions at a specified energy with a low spread of axial energies. Collision cell 415 can constrain the axial and radial energy spread of the ions. For example, collision cell 415 can act as a cooling cell to reduce ion energy to a desired value (or at least a narrow range around the desired value). Also, the radial energies of the ions can be minimized such that, after being subsequently accelerated in the axial direction, the ions mostly travel in the axial direction before entering the quadrupole filter. As an example, the collision cell can include an inert gas, such as helium. In this manner, the ions can have a same starting energy, which can facilitate obtaining similar detection patterns across masses.

Ion optics 417 can accelerate the ions via a DC axial voltage and focus the ions into quadrupole filter 430. Ion optics 417 can be connected to DC axial voltage supply 425. The ion optics can be of any suitable form, e.g., one or more plates having specified voltages. In one embodiment, a controller 480 can control the DC axial voltage that is used to accelerate the ions. The DC axial voltage is one setting that can be chosen to maintain substantially constant RF cycles across masses. Example DC axial voltages are 10V to 200V.

Quadrupole filter 430 includes four rods, although only two rods are shown for ease of illustration. DC voltage supply 440 and AC voltage supply 450 are coupled to the rods of quadrupole filter 430. Controller 480 can control DC voltage supply 440 and AC voltage supply 450 to maintain a stable operating region for parameters a and q, as part of the scan. Controller 480 can control the AC voltage amplitude and RF frequency of the AC signal from AC voltage supply 450. Connecting wires are shown for sending control signals from controller 480 to DC voltage supply 440 and AC voltage supply 450. Additional connecting wires are shown for sending voltages from DC voltage supply 440 and AC voltage supply 450 to quadrupole filter 430.

Once ions with a stable trajectory pass through quadrupole filter 430, the ions can pass through exit aperture 460 and be detected by ion detector 470. The ion detector 470 can include detection electronics for converting the detection signal to an electronic signal, which can be captured by a computer. Various parts of quadrupole mass spectrometer 400 can be held at a vacuum by a high-vacuum system (not shown).

Also, as indicated in FIG. 4, each mass undergoes substantially a fixed number of RF cycles when traveling through quadrupole filter 430. In order to scan for different masses while maintaining mass-invariant RF cycles, staying in the a-q stable region, and avoiding extreme axial voltages at the ion optics, controller 480 can vary the frequency of the RF voltage from AC voltage supply 450 during scanning. As discussed below in detail, the axial voltage at ion optics 417 and/or the magnitude of voltages output by DC voltage supply 440 and AC voltage supply 450 may also be adjusted during scanning.

Using conventional techniques, the mass limits for accurate results differed between different types of experiments. A standard full scan showed good resolution down to near 130 amu. During a fragmentation product scan, however, the lower limit was much higher, closer to 300 amu or more at the very lowest for a high resolution result. The upper limit is about 1500 amu. Using embodiments, the mass limits for accurate results can reach below 100 amu, especially in a full scan mode, and potentially reach masses around 50 amu with high quality results. The upper limit can be limited by the detection capability, which can be in the tens of thousands of amu range.

B. Method

Figure 5:
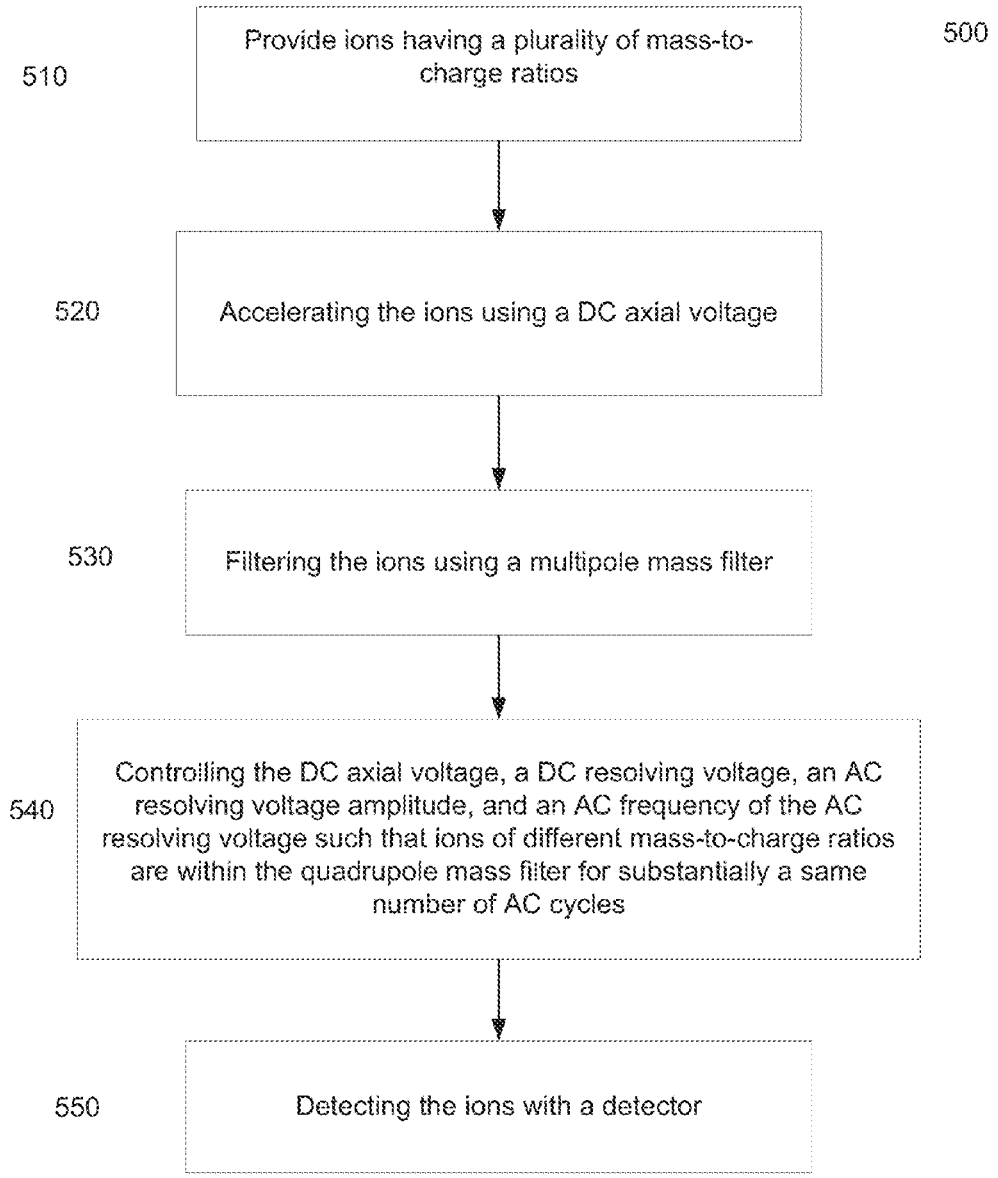
FIG. 5 is a flowchart of a method 500 for changing frequency to maintain RF cycle invariance during scanning according to embodiments of the present invention.

FIG. 5 is a flowchart of a method 500 for changing frequency to maintain RF cycle invariance during scanning according to embodiments of the present invention. Method 500 can be performed using the spectrometer 400 and can provide a mass spectrum of the sample.

At block 510, ions are provided that have a plurality of mass-to-charge ratios. The ions can be provided by ion source (e.g., 410) that ionizes molecules of a sample.

At block 520, the ions are accelerated using a DC axial voltage such that the ions pass through a multipole mass filter. As examples, the multipole mass filter can be a quadrupole or octupole mass filter. In one embodiment, the DC axial voltage can be applied by ion optics (e.g., ion optics 417). The DC axial voltage can be supplied by DC axial voltage supply, which can be controlled to provide a specified DC voltage, which can vary over time.

At block 530, the ions are filtered using the multipole mass filter. The multipole mass filter can be coupled to a DC power supply providing a DC resolving voltage, and an AC power supply providing an AC voltage. The AC voltage has an AC voltage amplitude and an AC frequency, both of which can vary over time. The DC resolving voltage can also vary over time.

At block 540, the DC axial voltage, the DC resolving voltage, the AC voltage amplitude, and the AC frequency are controlled such that ions of different mass-to-charge ratios are within the multipole mass filter for substantially a same number of AC cycles when a range of mass-to-charge ratios are scanned. The controlling includes changing the AC frequency. The controlling also includes changing at least one of: (1) the DC axial voltage, and (2) the DC resolving voltage and the AC voltage amplitude. Embodiments can change just (1) or just (2), where changing (2) involves changing the DC resolving voltage and the AC voltage amplitude. Embodiments can also change (1) and (2).

At block 550, the ions are detected with a detector. In one embodiment, the detector can determine a two-dimensional position of an ion on a surface of the detector. Detector 366 is an example of such a detector. A computer system can analyze the raw data to determine the mass spectrum, as described herein and in U.S. Pat. No. 8,389,929 and U.S. patent application Ser. No. 14/263,947.

In some embodiments, the DC axial voltage is kept constant over the range of mass to-charge ratios. The AC frequency can decrease from lower mass to-charge ratio to higher mass to-charge ratio, and the DC resolving voltage and the AC voltage amplitude can decrease from lower mass to-charge ratio to higher mass to-charge ratio. In this manner, the DC axial voltage can be prevented from getting too high.

Different scanned ranges can have the parameters changed in different ways. For example, the DC axial voltage can be kept constant for a first range of masses, as mentioned in the paragraph above. Then, a scan of a second range of masses can be performed in a different mode. For example, the DC axial voltage can be increased over the second range, the AC frequency can be kept constant, and the DC resolving voltage and the AC voltage amplitude can be increased over the second range.

In another mode, the DC resolving voltage and the AC voltage amplitude are kept constant. In such mode, the AC frequency can decrease as the square root of mass-to-charge ratio, and the DC axial voltage can increase as the square root of mass-to-charge ratio.

In some embodiments, the masses are scanned from low to high, and the AC frequency is decreased with increasing mass-to-charge ratio. In one embodiment, the DC resolving voltage and the AC voltage amplitude are decreased with increasing mass-to-charge ratio over the range of mass to-charge ratios. In another embodiment, the DC resolving voltage and the AC voltage amplitude are kept constant with increasing mass-to-charge ratio over the range of mass to-charge ratios. In such an embodiment, the AC frequency can decrease as the square root of mass-to-charge ratio, and the DC axial voltage can increase as the square root of mass-to-charge ratio.

Further options for adjusting the settings are provided below.

VI. VARIOUS MODES OF OPERATION

Figure 7:
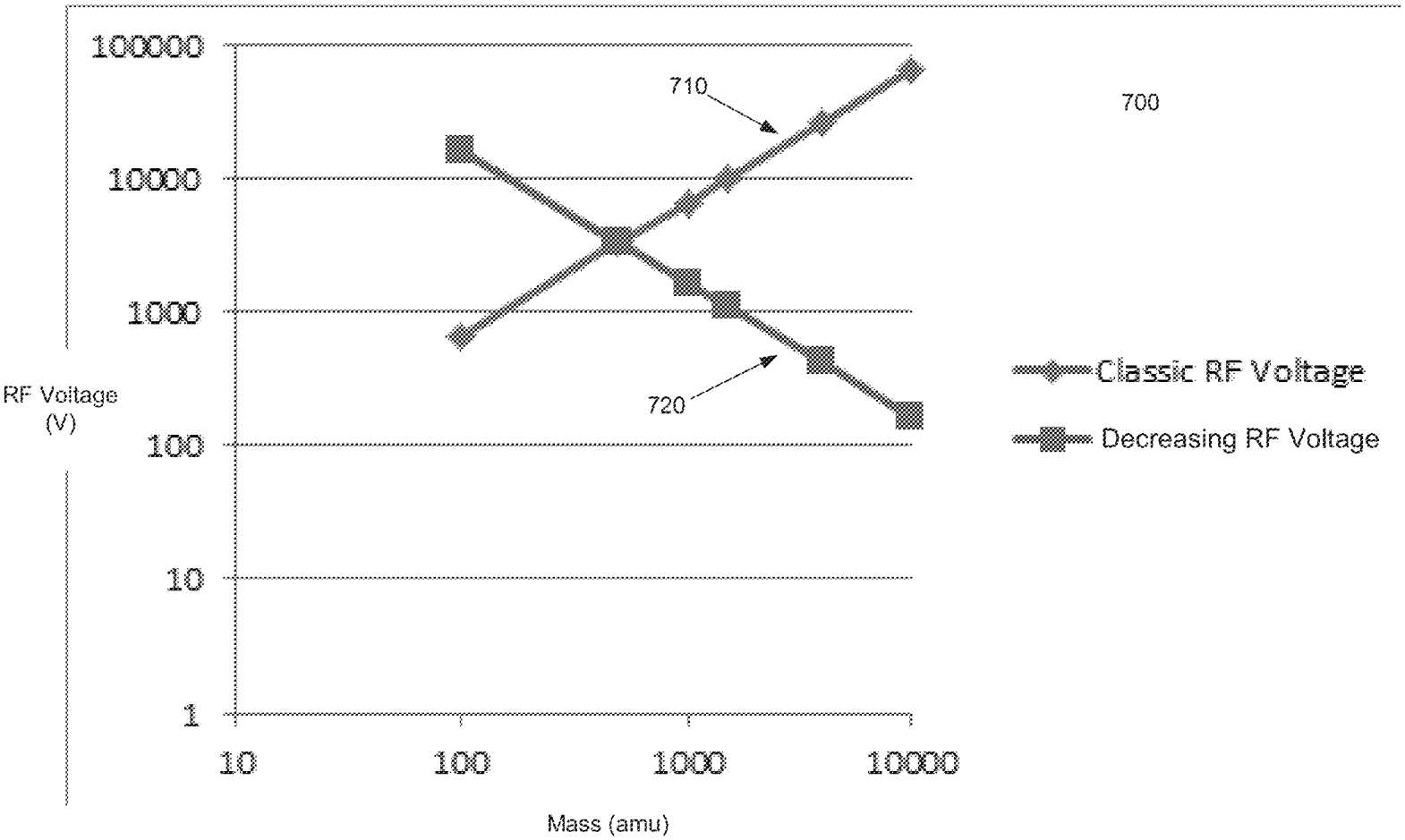
FIG. 7 shows a diagram with a classic RF voltage amplitude scan and an alternative RF amplitude voltage scan according to embodiments of the present invention.
Figure 8:
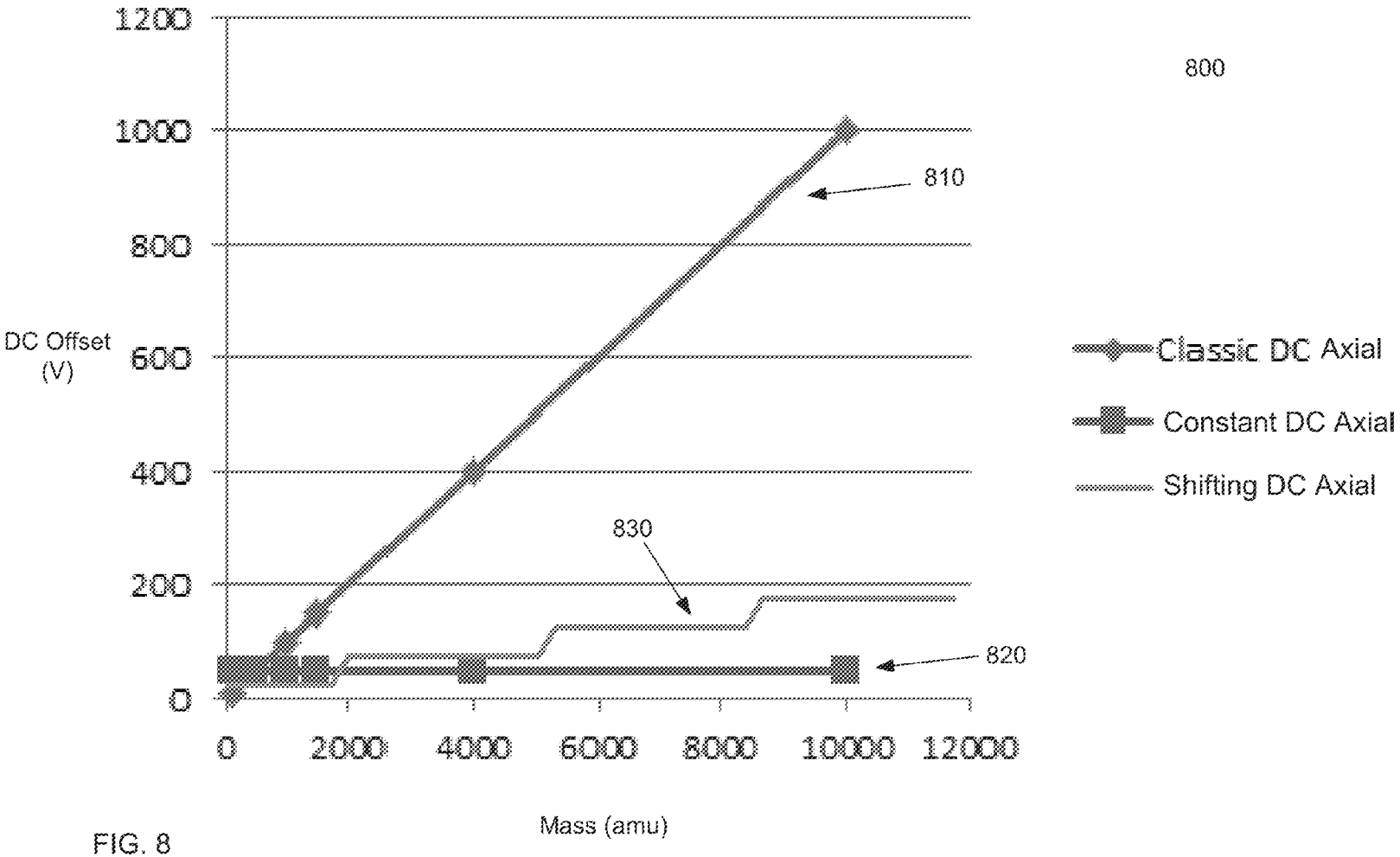
FIG. 8 shows a diagram with a classic DC axial voltage scan and an alternative DC axial voltage scan according to embodiments of the present invention.

In the classic case, when scanning with a quadrupole mass spectrometer in a broad-stability mode, frequency is held constant (see horizontal line 610 in FIG. 6), and U and V are increased linearly with mass (see increasing line 710 in FIG. 7), and axial voltage is increased with mass (see increasing line 810 in FIG. 8). This method can maintain a constant number of RF cycles, but suffers from problems at low and high masses. When RF frequency variation is introduced, the remaining settings can change in various ways, thereby avoiding problems at low and high masses.

Figure 6:
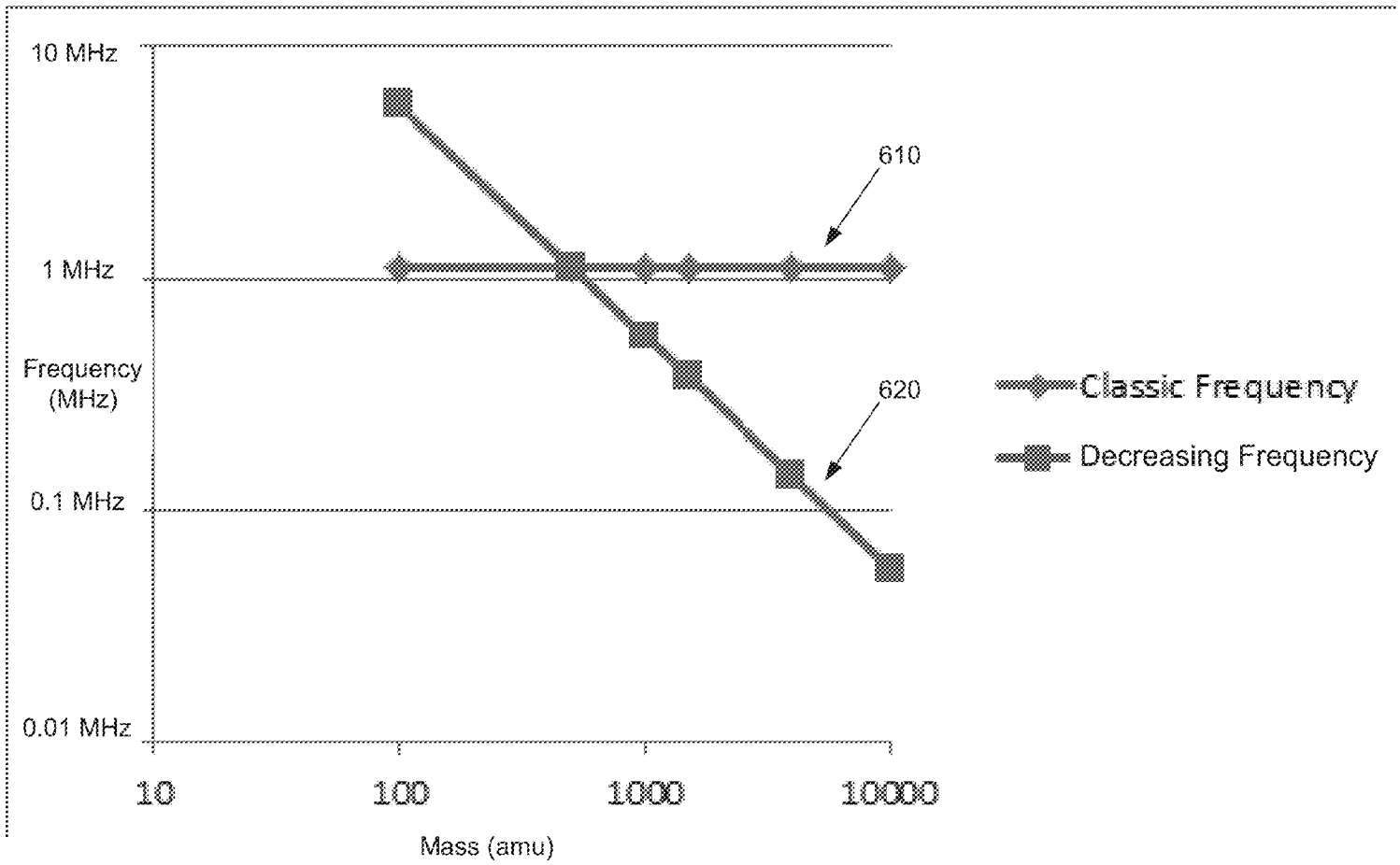
FIG. 6 shows a diagram with a classic scan, where RF frequency is constant within a mass range, and an alternative scan, where RF frequency changes with mass according to embodiments of the present invention.

FIG. 6 shows a diagram 600 with a classic RF frequency scan and an alternative RF frequency scan according to embodiments of the present invention. Diagram 600 is in logarithmic scale. The vertical axis corresponds to frequency in MHz of the AC voltage signal on the quadrupole rods, and the horizontal axis corresponds to mass in amu. Horizontal line 610 shows the classic frequency setting being kept fixed.

Frequency function 620 shows an alternative frequency setting decreasing with increasing mass. Frequency function 620 can have various functional forms, e.g., linear, a square root power function, exponential, or logarithmic mode, some of which may be chosen for implementation with the electronics. As explained above, larger masses will generally have a slower speed so that large axial voltages are not required. Thus, ions with large masses will spend more time in the quadrupole filter. However, the frequency is decreased to compensate for this slower speed, such that the larger masses will still experience substantially the same number of RF cycles. The other settings can remain fixed or also can change. Examples modes are describes below.

FIG. 7 shows a diagram 700 with a classic RF voltage amplitude scan and an alternative RF amplitude voltage scan according to embodiments of the present invention. Diagram 700 is in logarithmic scale. The vertical axis corresponds to the AC voltage amplitude in V on the quadrupole rods, and the horizontal axis corresponds to mass in amu. The increasing line 710 shows the classic RF voltage setting, where high RF amplitudes are needed at high masses, since the RF frequency w stays constant. The DC resolving voltage would behave in a similar manner.

AC amplitude function 720 shows an alternative RF amplitude setting decreasing with increasing mass. AC amplitude function 620 can have various functional forms, e.g., linear. When the RF frequency w decreases, the RF amplitude can decrease, depending on the rate of rate of decrease of the RF frequency w. Depending on the rate of decrease of the RF frequency function, AC amplitude function 720 could increase or be constant, e.g., decreasing the frequency proportional to the square root of mass instead of linearly results in a constant RF amplitude.

As one can see in the Mathieu equations, the RF frequency is in the denominator with a power of two. Thus, even if V decreases, a decreasing w can allow a and q to be in the stable region when mass m is increasing. The exact relationship between the change in w and V can be determined to ensure that a and q are in the stable region while mass m is increasing.

FIG. 8 shows a diagram 800 with a classic DC axial voltage scan and an alternative DC axial voltage scan according to embodiments of the present invention. The vertical axis corresponds to the DC axial voltage in eV on the ion optics, and the horizontal axis corresponds to mass in amu. The DC axial voltage can specify the desired mass the scan is centered at for any given moment in time.

Increasing line 810 shows a classic DC axial scan setting, where high voltages are required at high masses. This way, higher energies are applied to larger masses, such that the masses can reach substantially the same speed as the smaller masses. Thus, as each mass achieves substantially the same speed through quadrupole filter and the frequency is constant, each mass experiences substantially the same number of RF cycles.

Horizontal line 820 shows an alternative DC axial scan setting that stays constant with increasing mass. If the RF frequency decreases, the speed can also decrease so as to maintain constant RF cycles. Axial voltage function 830 corresponds to another DC axial scan setting that increases in steps. Axial voltage function 830 is constant for certain scan periods and then increases. The RF frequency and resolving voltages can also have a similar scan structure that has a rate of decrease change at certain time periods. Although axial voltage function 830 does increase, the amount of increase is not nearly as large as increasing line 810. Accordingly, various scan modes can be used when RF frequency decreases while maintaining constant RF cycles. Additional descriptions of various scan modes are described below.

A. Decreasing Frequency, Constant Axial voltage, and Decreasing U and V

As mentioned above, the RF frequency w can decrease in a scan across masses that maintains a constant number of RF cycles encountered by the ions as they pass through the quadrupole. During such a scan, some embodiments can hold the axial voltage constant (see horizontal line 820 in FIG. 8). If the DC axial voltage is fixed, then the RF cycle count can become invariant with mass by decreasing RF frequency in synchronization with the decrease in speed as mass increases. Given that the decrease in speed (due to same acceleration voltage, but larger mass) is matched with a decrease in RF frequency, the larger masses will encounter the same number of RF cycles. The larger masses will spend more time in the quadrupole, but there are fewer RF cycles per unit time, thereby providing a same number of RF cycles.

In one embodiment, to maintain the a-q scanning one can scan U and V in a linearly decreasing manner (on a log scale) with the mass (see AC amplitude function 720 in FIG. 7). This decrease in U and V conveniently removes the high mass limit, which normally occurs due to a need for excessive voltage on the quadrupole rods. And, in this mode, the upper mass range would use less power to operate at than lower masses. Thus, when scanning from low to high mass, the RF frequency, U, and V can decrease (e.g., linearly).

In some embodiments, the scan may start at high mass and drop to low mass. In that scenario, frequency, U, and V would all increase linearly (on a log scale). This relationship between parameters ensures that the number of RF cycles is constant across masses while keeping the desired range of masses in the desired points of the stable a-q region. As mentioned above for FIG. 2, the scan line for a particular mass will have the particular mass be stable for a range of a and q values. For example, for a given a and q, in order to double the mass and keep a and q the same, the RF frequency, U, and V would all be reduced by half. This can be seen by looking at the Mathieu Equations. Similarly, if the mass is reduced by half, the RF frequency, U, and V would double in order to stay at the same a and q position. In some embodiments, keeping the axial voltage constant and linearly decreasing RF frequency, U, and V with increased mass provides an optimal setting for keeping RF cycle constant throughout the scan.

As mentioned above, keeping the axial voltage constant means that the axial energy applied to each ion will be the same. It follows that ions of different masses will have substantially the same energy and different velocities. In practice, the constant axial voltage may be in the range of 50 to 100 V, with a typical minimum of 50 V.

Mass spectrometers often involve breaking molecules apart, and as a result there is excess energy. To reduce the excess energy, the ions can be cooled (e.g., in a collision cell), but there is still some spread in energies after cooling. 50 V is a good minimum amount of energy to apply to the ions, because any remaining velocity spread among the ions is relatively small compared to the average velocity, even at low masses. Also, a high RF frequency is used for low masses because they will have a relatively high velocity, thereby keeping the RF cycles the same. Accordingly, 100 V is a good maximum axial voltage, because higher axial voltages will create even faster low mass ions, and this in turn may require very high frequencies. Thus, keeping axial voltage 100 V or lower allows for reasonable RF frequencies, even for low masses.

B. Decreasing Frequency, Increasing Axial voltage, and Changing U and V

In another embodiment, the axial voltage can increase while the RF frequency decreases. The increase of the axial voltage can be continuous or occur in steps, e.g., as shown in axial voltage function 830. If both the axial voltage and the RF frequency are changed at the same time, mass-invariant RF cycle count can still be achieved by adjusting the RF frequency and axial voltage at corresponding rates. To maintain the a-q stability region, the U and V parameters may increase or decrease with mass, depending on the rate at which the frequency is decreased and the rate at which the axial voltage is increased.

When the axial voltage increases in steps, this can essentially combine the scenario where frequency is fixed while axial voltage changes and the scenario where axial voltage is fixed while frequency changes. One option is to initially hold the axial voltage constant and decrease the RF frequency over a certain mass range. For example, a first portion of a scan for a certain range of masses might involve a fixed axial voltage and a changing frequency. This part of the scan might be for smaller masses, and a higher than typical axial voltage might be used while frequency is varied. The RF frequency can start high and decrease Then, the next portion of the scan, which might be a middle mass range, might use a fixed frequency and an increasing axial voltage (e.g., to a next magnitude). Once the axial voltage reaches a desired value and then held constant, the RF frequency can decrease and the axial voltage held constant for another section of the frequency range. This sort of step pattern can continue for any number of iterations until the scan is complete.

This mode can be viewed as an RF frequency scan, but with different static axial voltages for different parts of the scan (see axial voltage function 830 in FIG. 8). The RF frequency and axial voltage can be matched at each point such that RF cycles are invariant with mass and such that the scan is in a stable a-q region. In one embodiment, the U and V values can decrease during frequency scanning, but increase when axial voltage is changed.

For a continuous change in axial voltage, the slope (or just the raw values) can be less than the classic DC axial voltage, shown as 810 in FIG. 8. The RF frequency would still decrease, but not as much as when the axial voltage is kept fixed. The change in U and V would also be affected, as they are synchronized with the change in RF frequency. For example, a slower decrease in the RF frequency would result in a smaller decrease for U and V. And, if the RF frequency decreased by a factor of $\sqrt{2}$ for a doubling of mass, then U and V can remain constant. For decreases of less than $\sqrt{2}$ for a doubling of mass, then U and V would increase. But, such a mode could result in high axial voltages still being required, depending on the rate of decrease of the RF frequency. This mode might be desirable to reduce the required change in RF frequency, e.g., have a smaller range than 2 megahertz to 50 kilohertz.

These techniques where axial voltage and frequency are both changed during a scan, either concurrently are alternatingly, can still provide the advantages of allowing good resolution at low and high masses, and it can allow for a simpler system. For example, it may be easier to provide a system that only provides a limited frequency bandwidth scanning range, so that frequency scan range may be used in combination with a range of axial voltages.

Embodiments that change the axial voltage may be desirable when the mass range to be scanned is large. In such a case, the range of RF frequencies might be too large. In production runs where the mass range to be scanned is not too large, keeping the axial voltage fixed might be desirable.

C. Decreasing Frequency, Increasing Axial Voltage, and Constant U and V

In some embodiments, the axial voltage can be increased and the frequency can be decreased concurrently, such that U and V can be held constant. In the case where axial voltage increases while frequency is fixed, U and V increase with mass. In the case where frequency decreases while axial voltage is fixed, U and V decrease with mass. As discussed above, axial voltage can be increased at a slower rate while frequency is decreased at a slower rate, as long as the rates match such that the RF cycle count remains mass-invariant.

If the RF frequency decreased by a factor of $\sqrt{2}$ for a doubling of mass, then U and V can remain constant. Thus, a scan can occur in the a-q stable region with mass-invariant RF cycles where both axial voltage and frequency change, but where U and V are held constant. When RF frequency decreases by a factor of $\sqrt{2}$ for a doubling of mass, the DC axial voltage is increased as a square root of mass.

This special case may be, for practical use, relatively easier to implement electronically. However, it may not be the optimal solution for maintaining constant RF cycle count, as the RF cycles may have some variance compared to, for example, the scenario where axial voltage is fixed and frequency is decreased. But, such a mode would use less bandwidth to operate the AC voltage, which means it can be easier to implement. Still, such a mode may have less RF cycle variance than the scenario where frequency is fixed and axial voltage is varied because of the issues that occur when axial energies that are too low or too high.

D. Equation

As part of determining the values of RF frequency, U, V, and DC axial voltage, an initial step can be to determine the trajectory of the scan through the a-q stability region. Once the a and q values are determined, a desired number of RF cycles and a mode can be selected. Any combination of changing the settings of the parameters, e.g., where different modes are used for different parts of the scan, is possible. For example, the scan could start with the axial voltage being constant, and the RF frequency, U, and V decreasing. For a next section, the axial voltage could increase slightly (e.g., as the square root of mass), and the RF frequency could decrease as the square root of mass, and U and V could stay constant. And, in another section, the RF frequency could be constant, with the axial voltage, U, and V increasing linearly with mass.

A general relationship between the parameter is given as follows. For mass invariant a,q values with constant RF cycle count, any values satisfying the following are allowed. To satisfy a constant a,q values, the following relationship is satisfied:

$$m \propto \frac{U}{w^2} \propto \frac{V}{w^2}.$$

To satisfy the constant RF cycle count, the following is satisfied:

$$m \propto \frac{\text{Axial Voltage}}{w}.$$

Any values which satisfy both equations are allowed. If the axial voltage is fixed, then we see that frequency decreases in order to change the mass, which results in decreasing U, V values. Additionally if we fix U, V values, then frequency decreases as a square root of desired mass, which results in axial voltage increasing in a square root manner.

VII. EXAMPLES

As an example, currently an axial voltage of 50V on the quadrupole may be required at mass 500 for a reasonable result while scanning at a fixed RF frequency of 1.123 MHz and approximately 3 kV Rod-Rod RF Voltage. At the range of 1500 amu, these values turn into a DC axial voltage of 150V and an AC voltage amplitude of 10 kV, with the RF voltage amplitude limiting the mass range and causing design limitations. DC resolving voltages are a little bit lower and are not the physical limit of operation.

Using embodiments, the axial voltage could remain at 50V, but at mass 1500 amu, the RF voltage amplitude would have dropped to 1 kV along with a corresponding drop in frequency to 374 kHz. The top mass range would not have an electrical limit and with useful resolution provided by the broader stability mode, it is conceivable to have a device going to much higher useful masses. The new limit would likely be the dynode conversion efficiency, which might become a detection efficiency issue in the vicinity of 10,000 amu.

In exchange for this removal of the high mass limit, which is accompanied with vastly lower power consumption, RF heating, and a removal of random high mass noise associated with high RF voltages, there can be the introduction of a low mass limit. This low mass limit can be the result of needing very high RF frequencies, as well as high resolving voltages. The low mass limit can be determined for this mode, or the classic mode can be reintroduced to accommodate lower masses. For example, the axial voltage could be decreased. With the combined change of axial voltage and change in RF frequency, lower masses can be scanned (i.e., lower than techniques that used lower RF frequencies).

VIII. COMPUTER SYSTEM

Figure 9:
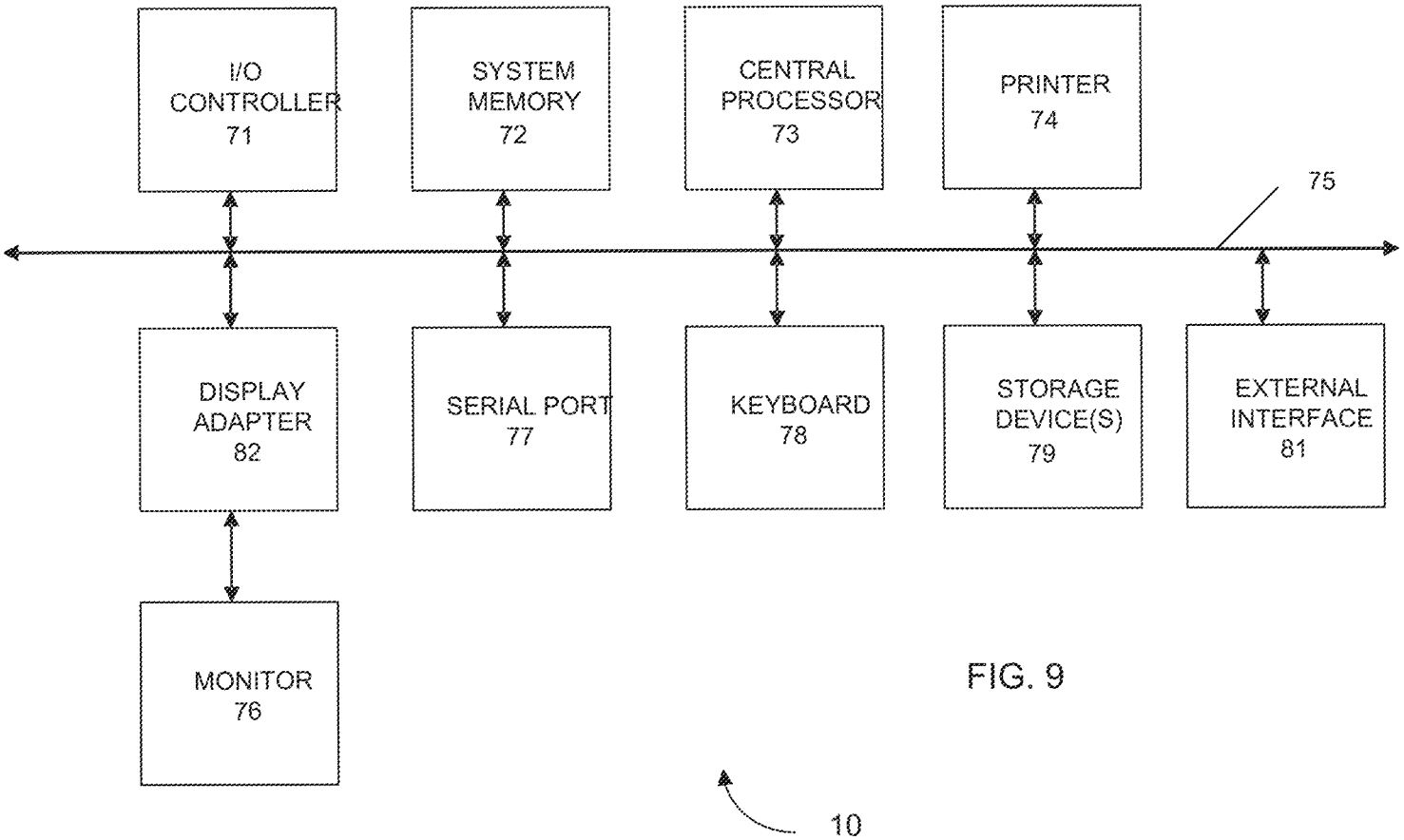
FIG. 9 shows a block diagram of an example computer system 10 usable with system and methods according to embodiments of the present invention.

Any of the computer systems (e.g., controller 480) mentioned herein may utilize any suitable number of subsystems. Examples of such subsystems are shown in FIG. 9 in computer apparatus 10. In some embodiments, a computer system includes a single computer apparatus, where the subsystems can be the components of the computer apparatus. In other embodiments, a computer system can include multiple computer apparatuses, each being a subsystem, with internal components.

The subsystems shown in FIG. 9 are interconnected via a system bus 75. Additional subsystems such as a printer 74, keyboard 78, storage device(s) 79, monitor 76, which is coupled to display adapter 82, and others are shown. Peripherals and input/output (I/O) devices, which couple to I/O controller 71, can be connected to the computer system by any number of means known in the art such as input/output (I/O) port 77 (e.g., USB, FireWire®). For example, I/O port 77 or external interface 81 (e.g. Ethernet, Wi-Fi, etc.) can be used to connect computer system 10 to a wide area network such as the Internet, a mouse input device, or a scanner. The interconnection via system bus 75 allows the central processor 73 to communicate with each subsystem and to control the execution of instructions from system memory 72 or the storage device(s) 79 (e.g., a fixed disk, such as a hard drive or optical disk), as well as the exchange of information between subsystems. The system memory 72 and/or the storage device(s) 79 may embody a computer readable medium. Any of the data mentioned herein can be output from one component to another component and can be output to the user.

A computer system can include a plurality of the same components or subsystems, e.g., connected together by external interface 81 or by an internal interface. In some embodiments, computer systems, subsystem, or apparatuses can communicate over a network. In such instances, one computer can be considered a client and another computer a server, where each can be part of a same computer system. A client and a server can each include multiple systems, subsystems, or components.

It should be understood that any of the embodiments of the present invention can be implemented in the form of control logic using hardware (e.g. an application specific integrated circuit or field programmable gate array) and/or using computer software with a generally programmable processor in a modular or integrated manner. As used herein, a processor includes a multi-core processor on a same integrated chip, or multiple processing units on a single circuit board or networked. Based on the disclosure and teachings provided herein, a person of ordinary skill in the art will know and appreciate other ways and/or methods to implement embodiments of the present invention using hardware and a combination of hardware and software.

Any of the software components or functions described in this application may be implemented as software code to be executed by a processor using any suitable computer language such as, for example, Java, C, C++, C# or scripting language such as Perl or Python using, for example, conventional or object-oriented techniques. The software code may be stored as a series of instructions or commands on a computer readable medium for storage and/or transmission, suitable media include random access memory (RAM), a read only memory (ROM), a magnetic medium such as a hard-drive or a floppy disk, or an optical medium such as a compact disk (CD) or DVD (digital versatile disk), flash memory, and the like. The computer readable medium may be any combination of such storage or transmission devices.

Such programs may also be encoded and transmitted using carrier signals adapted for transmission via wired, optical, and/or wireless networks conforming to a variety of protocols, including the Internet. As such, a computer readable medium according to an embodiment of the present invention may be created using a data signal encoded with such programs. Computer readable media encoded with the program code may be packaged with a compatible device or provided separately from other devices (e.g., via Internet download). Any such computer readable medium may reside on or within a single computer product (e.g. a hard drive, a CD, or an entire computer system), and may be present on or within different computer products within a system or network. A computer system may include a monitor, printer, or other suitable display for providing any of the results mentioned herein to a user.

Any of the methods described herein may be totally or partially performed with a computer system including one or more processors, which can be configured to perform the steps. Thus, embodiments can be directed to computer systems configured to perform the steps of any of the methods described herein, potentially with different components performing a respective steps or a respective group of steps. Although presented as numbered steps, steps of methods herein can be performed at a same time or in a different order. Additionally, portions of these steps may be used with portions of other steps from other methods. Also, all or portions of a step may be optional. Additionally, any of the steps of any of the methods can be performed with modules, circuits, or other means for performing these steps.

The specific details of particular embodiments may be combined in any suitable manner without departing from the spirit and scope of embodiments of the invention. However, other embodiments of the invention may be directed to specific embodiments relating to each individual aspect, or specific combinations of these individual aspects.

The above description of exemplary embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated.

A recitation of "a", "an" or "the" is intended to mean "one or more" unless specifically indicated to the contrary. The use of "or" is intended to mean an "inclusive or," and not an "exclusive or" unless specifically indicated to the contrary.

All patents, patent applications, publications, and descriptions mentioned here are incorporated by reference in their entirety for all purposes. None is admitted to be prior art.

What is claimed is:

1. A method of operating a mass spectrometer, the method comprising:

providing ions having a plurality of mass-to-charge ratios;

accelerating the ions using a DC axial voltage such that the ions pass through a multipole mass filter;

filtering the ions using the multipole mass filter, the multipole mass filter coupled to:

a DC power supply providing a DC resolving voltage, and an AC power supply providing an AC voltage, the AC voltage having an AC voltage amplitude and an AC frequency:

controlling the DC axial voltage, the DC resolving voltage, the AC voltage amplitude, and the AC frequency such that ions of different mass-to-charge ratios are within the multipole mass filter for substantially a same number of AC cycles when a first range of mass-to-charge ratios is scanned, wherein the controlling includes:

decreasing the AC frequency from lower mass-to-charge ratio to higher mass-to-charge ratio while:

keeping the DC axial voltage constant over the first range of mass-to-charge ratios, and decreasing the DC resolving voltage and the AC voltage amplitude from lower mass-to-charge ratio to higher mass-to-charge ratio;

detecting the ions with a detector;

increasing the DC axial voltage over a second range of mass-to-charge ratios;

keeping the AC frequency constant over the second range of mass-to-charge ratios; and increasing the DC resolving voltage and the AC voltage amplitude over the second range of mass-to-charge ratios.

2. A method of operating a mass spectrometer, the method comprising:

providing ions having a plurality of mass-to-charge ratios;

accelerating the ions using a DC axial voltage such that the ions pass through a multipole mass filter;

filtering the ions using the multipole mass filter, the multipole mass filter coupled to:

a DC power supply providing a DC resolving voltage, and an AC power supply providing an AC voltage, the AC voltage having an AC voltage amplitude and an AC frequency;

controlling the DC axial voltage, the DC resolving voltage, the AC voltage amplitude, and the AC frequency such that ions of different mass-to-charge ratios are within the multipole mass filter for substantially a same number of AC cycles when a range of mass-to-charge ratios is scanned, wherein the controlling includes:

decreasing the AC frequency as the square root of mass-to-charge ratio while:

increasing the DC axial voltage as the square root of mass-to-charge ratio, and keeping the DC resolving voltage and the AC voltage amplitude constant; and detecting the ions with a detector.

3. A method of operating a mass spectrometer, the method comprising:

providing ions having a plurality of mass-to-charge ratios;

accelerating the ions using a DC axial voltage such that the ions pass through a multipole mass filter;

filtering the ions using the multipole mass filter, the multipole mass filter coupled to:

a DC power supply providing a DC resolving voltage, and an AC power supply providing an AC voltage, the AC voltage having an AC voltage amplitude and an AC frequency;

controlling the DC axial voltage, the DC resolving voltage, the AC voltage amplitude, and the AC frequency such that ions of different mass-to-charge ratios are within the multipole mass filter for substantially a same number of AC cycles when a range of mass-to-charge ratios is scanned in an increasing manner, wherein the controlling includes:

decreasing the AC frequency with increasing mass-to-charge ratio while:

increasing the DC axial voltage as the square root of mass-to-charge ratio, and keeping the DC resolving voltage and the AC voltage amplitude constant with increasing mass-to-charge ratio over the range of mass-to-charge ratios; and detecting the ions with a detector.

4. A mass spectrometer comprising:

a mass filter having a plurality of rods;

a DC resolving voltage power supply coupled to the plurality of rods and configured to provide a DC resolving voltage to the plurality of rods;

an AC voltage power supply coupled to the plurality of rods and configured to provide an AC voltage to the plurality of rods, the AC voltage having an AC voltage amplitude and an AC frequency;

ion optics for receiving ions and accelerating the ions toward the mass filter;

a DC axial voltage supply coupled to the ion optics and configured to provide a DC axial voltage to the ion optics, the DC axial voltage for accelerating the ion optics; and a controller coupled to the DC resolving voltage power supply, the AC voltage power supply, and the DC axial voltage supply, wherein the controller is configured to control the DC axial voltage, the DC resolving voltage, the AC voltage amplitude, and the AC frequency such that ions of different mass-to-charge ratios are within the multipole mass filter for substantially a same number of AC cycles when a first range of mass-to-charge ratios is scanned, wherein the controlling includes changing the AC frequency while changing at least one of:

the DC axial voltage, and the DC resolving voltage and the AC voltage amplitude;

wherein the controller is further configured to:

keep the DC axial voltage constant over the first range of mass-to-charge ratios, decrease the AC frequency from lower mass-to-charge ratio to higher mass-to-charge ratio, and decrease the DC resolving voltage and the AC voltage amplitude from lower mass-to-charge ratio to higher mass-to-charge ratio; and wherein the controller is further configured to:

increase the DC axial voltage over a second range of mass-to-charge ratios, keep the AC frequency constant over the second range of mass-to-charge ratios, and increase the DC resolving voltage and the AC voltage amplitude over the second range of mass-to-charge ratios.

5. A mass spectrometer comprising:

a mass filter having a plurality of rods;

a DC resolving voltage power supply coupled to the plurality of rods and configured to provide a DC resolving voltage to the plurality of rods;

an AC voltage power supply coupled to the plurality of rods and configured to provide an AC voltage to the plurality of rods, the AC voltage having an AC voltage amplitude and an AC frequency;

ion optics for receiving ions and accelerating the ions toward the mass filter;

a DC axial voltage supply coupled to the ion optics and configured to provide a DC axial voltage to the ion optics, the DC axial voltage for accelerating the ion optics; and a controller coupled to the DC resolving voltage power supply, the AC voltage power supply, and the DC axial voltage supply, wherein the controller is configured to control the DC axial voltage, the DC resolving voltage, the AC voltage amplitude, and the AC frequency such that ions of different mass-to-charge ratios are within the multipole mass filter for substantially a same number of AC cycles when a range of mass-to-charge ratios is scanned, wherein the controlling includes changing the AC frequency while changing at least one of:

the DC axial voltage, and the DC resolving voltage and the AC voltage amplitude; and wherein the controller is further configured to:

keep the DC resolving voltage and the AC voltage amplitude constant over the range of mass-to-charge ratios, decrease the AC frequency as the square root of mass-to-charge ratio, and increase the DC axial voltage as the square root of mass-to-charge ratio.

6. A computer product comprising a non-transitory computer readable medium storing a plurality of instructions that when executed control a computer system to operate a mass spectrometer, the mass spectrometer comprising settings of: a DC resolving voltage applied to the plurality of rods; an AC voltage applied to the plurality of rods, the AC voltage having an AC voltage amplitude and an AC frequency; and a DC axial voltage for accelerating ions to the plurality of rods, the instructions comprising:

controlling the DC axial voltage, the DC resolving voltage, the AC voltage amplitude, and the AC frequency such that ions of different mass-to-charge ratios are within the multipole mass filter for substantially a same number of AC cycles when a range of mass-to-charge ratios is scanned, wherein the controlling includes:

changing the AC frequency while changing at least one of:

the DC axial voltage, and the DC resolving voltage and the AC voltage amplitude; and wherein the controlling further includes:

keeping the DC resolving voltage and the AC voltage amplitude constant over the range of mass-to-charge ratios, decreasing the AC frequency as the square root of mass-to-charge ratio, and increasing the DC axial voltage as the square root of mass-to-charge ratio.

7. A method of operating a mass spectrometer, the method comprising:

providing ions having a plurality of mass-to-charge ratios;

accelerating the ions using a DC axial voltage such that the ions pass through a multipole mass filter;

filtering the ions using the multipole mass filter, the multipole mass filter coupled to:

a DC power supply providing a DC resolving voltage, and an AC power supply providing an AC voltage, the AC voltage having an AC voltage amplitude and an AC frequency;

controlling the DC axial voltage, the DC resolving voltage, the AC voltage amplitude, and the AC frequency over a range of mass-to-charge ratios, wherein the controlling includes:

keeping the DC resolving voltage and the AC voltage amplitude constant over the range of mass to-charge ratios;

decreasing the AC frequency as the square root of mass-to-charge ratio, and increasing the DC axial voltage as the square root of mass-to-charge ratio; and detecting the ions with a detector.

* * * * *